US007212226B2

(12) United States Patent
Tanaka

(10) Patent No.: US 7,212,226 B2
(45) Date of Patent: May 1, 2007

(54) IMAGE DENSITY CONTROL APPARATUS AND IMAGE FORMATION APPARATUS

(75) Inventor: Yasutoshi Tanaka, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 368 days.

(21) Appl. No.: 10/792,731

(22) Filed: Mar. 5, 2004

(65) Prior Publication Data

US 2004/0189788 A1 Sep. 30, 2004

(30) Foreign Application Priority Data

Mar. 25, 2003 (JP) ..... 2003-082523

(51) Int. Cl.
*B41J 2/47* (2006.01)

(52) U.S. Cl. ..... 347/253; 347/254

(58) Field of Classification Search ..... 347/240–254, 347/131, 133, 236–237; 382/237; 399/41, 399/46–47, 49, 51, 181, 72; 358/406, 475
See application file for complete search history.

(56) References Cited

U.S. PATENT DOCUMENTS 5,481,337 A 1/1996 Tsuchiya et al.
5,734,948 A * 3/1998 Nagayama et al. ..... 399/46
5,832,122 A * 11/1998 Shimazaki ..... 382/237
5,864,353 A 1/1999 Gila et al.
5,873,011 A * 2/1999 Takemoto et al. ..... 399/49
6,737,628 B2 * 5/2004 Fischer et al. ..... 250/208.1
6,917,374 B2 * 7/2005 Ohide ..... 347/131
2003/0012578 A1 1/2003 Ishii et al.

FOREIGN PATENT DOCUMENTS

JP 3-279971 12/1991
JP 2001-80113 3/2001

* cited by examiner

*Primary Examiner*—Hai Pham
(74) *Attorney, Agent, or Firm*—Greenblum & Bernstein, P.L.C.

(57) ABSTRACT

An image forming apparatus includes a memory which stores test pattern data. The test pattern data are configured for detecting a density of image data formed on a photo conductor. The image forming apparatus includes a laser unit which forms a plurality of test patterns on the photo conductor by utilizing A plurality of first laser powers based on test pattern data stored in the memory. The image forming apparatus includes a detector which illuminates each test pattern formed on the photo conductor by the plurality of the first laser powers, receives each light intensity reflected by the test patterns and provides output values corresponding to each received light intensity. The output values define a range of output values. The image forming apparatus includes a controller which compares each output value with a first predetermined value. The controller determines a laser power to be used based on the first value, when the first predetermined value falls within the range of the output values.

28 Claims, 20 Drawing Sheets all black test pattern black pixel white pixel

First checkered flag test pattern

Second checkered flag test pattern example for comparison

| | first checkered flag test pattern | second checkered flag test pattern | notes |
|---|---|---|---|
| 2 lines | 0.29V | 0.43V | sensor output when line width changes 10μm |
| 3 lines | 0.36V | 0.53V | |

printed data after binary error diffusion example for comparison

IMAGE DENSITY CONTROL APPARATUS AND IMAGE FORMATION APPARATUS

BACKGROUND OF THE INVENTION

1. Field of the Invention

This invention relates to an image density control apparatus that controls density of a toner image obtained from developing a latent image by toner, the latent image being formed on a photoconductor by an exposure unit. The invention also relates to an image formation apparatus having such an image density control apparatus.

2. Description of Related Art

As a solution to changes in density of toner images due to a deterioration of the photoconductor and/or varying environment conditions, image formation apparatuses using electrophotography technology (printer, facsimile apparatus, copier, etc.) often employ an image density controller that stabilizes the density at an appropriate level and controls image formation conditions such as intensity of laser beam. As an example of the image density control, a plurality of types of test patterns are used to control image formation conditions (Prior Art 1). Also, another invention proposes a control that especially focuses on line widths within an image (Prior Art 2).

Prior Art 1: Japanese Patent Laid Open H03-279971 (FIGS. 3 and 4)

Prior Art 2: Japanese Patent Laid Open 2001-80113 (FIGS. 3, 4, and 5)

The above described image density controls using such test patterns is able to largely control the image density so that the density is stabilized at an appropriate level despite a deterioration of the photoconductor and/or varying environment conditions. However, the above controls do not satisfy the need of securing a clear and high quality image for various types of images provided.

For example, the above image density controls cannot offer a flexible control where sufficiently thick toner (high density) is required for an all black central region of the image area configured with black pixels, in order to avoid partially missed or low toner areas, while relatively low density is required for thin lines and small characters, in order to avoid over-expanded lines and distorting characters.

Further, such an image density control employing test patterns is required to calculate an appropriate light intensity when a sensor detects the density of toner image from a test pattern. Therefore, highly accurate sensor detection is needed for a successful control that utilizes the test patterns. In addition, a more accurate control is needed since the conventional method cannot provide accurate density detection, when a sensor output reaches a saturation point depending on the types of test patterns.

SUMMARY OF THE INVENTION

The present invention addresses the above-described problems of conventional technologies. The purpose of the invention is to provide an image density control apparatus and an image formation apparatus that can obtain an accurate and stabilized image density despite a deterioration of the photoconductor and/or varying environment conditions, and reproduce a clear and high quality image from various types of original images. Further, another purpose of the invention is to improve the accuracy of toner image density detection by employing test patterns, and provide an accurate density control even when the sensor output reaches a saturation point.

BRIEF DESCRIPTION OF THE DRAWINGS

The present invention is further described in the detailed description which follows, with reference to the noted plurality of drawings by way of non- limiting examples of exemplary embodiments of the present invention, in which like reference numerals represent similar parts throughout the several views of the drawings, and wherein.

DETAILED DESCRIPTION OF PREFERRED EMBODIMENTS

The embodiments of the present invention are explained in the following, in reference to the above-described drawings.

Figure 1:
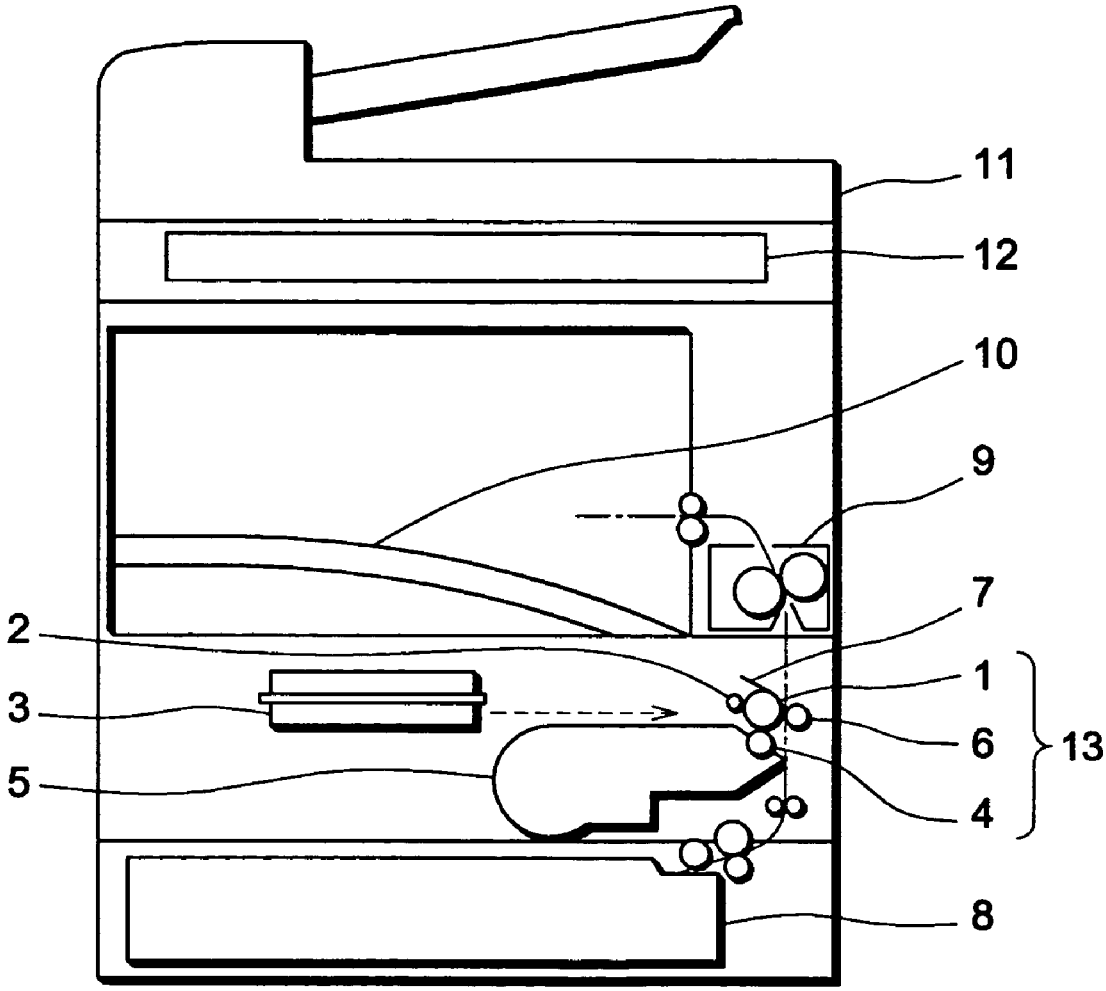
FIG. 1 is a schematic cross sectional view illustrating an image formation apparatus according to the invention.

FIG. 1 is a schematic cross sectional view illustrating an image formation apparatus according to the invention. The image formation apparatus includes photoconductor drum 1, charge roller 2 that evenly charges an image forming surface on photoconductor drum 1, LSU (laser scanning unit) 3 that forms a static latent image by running a flux of light for exposure on the image forming surface on photoconductor drum 1, developer roller 4 that develops the static latent image on the image forming surface on photoconductor drum 1, developer 5 having developer roller 4, transfer roller 6 transfers the toner image (formed on the image forming surface on photoconductor drum 1) onto a recording paper, and cleaning blade 7 that cleans the image forming surface on photoconductor drum 1. Further, when the recording paper from paper feeder 8 is delivered between photoconductor drum 1 and transfer roller 6, the paper is then ejected to exit unit 10 via fuser unit 9. In addition, the image formation apparatus also includes scanner 11 for copier and facsimile transmission functions.

The present image formation apparatus is provided with a power saver mode function that saves power consumption when the apparatus is idle. The image formation apparatus activates the power saver mode after a predetermined time period of no specific operation from operation display panel 12. The power saver mode shuts off the power supply to components including image formation unit 13 having photoconductor drum 1, LSU 3, etc., but not to operation display panel 12.

Figure 2:
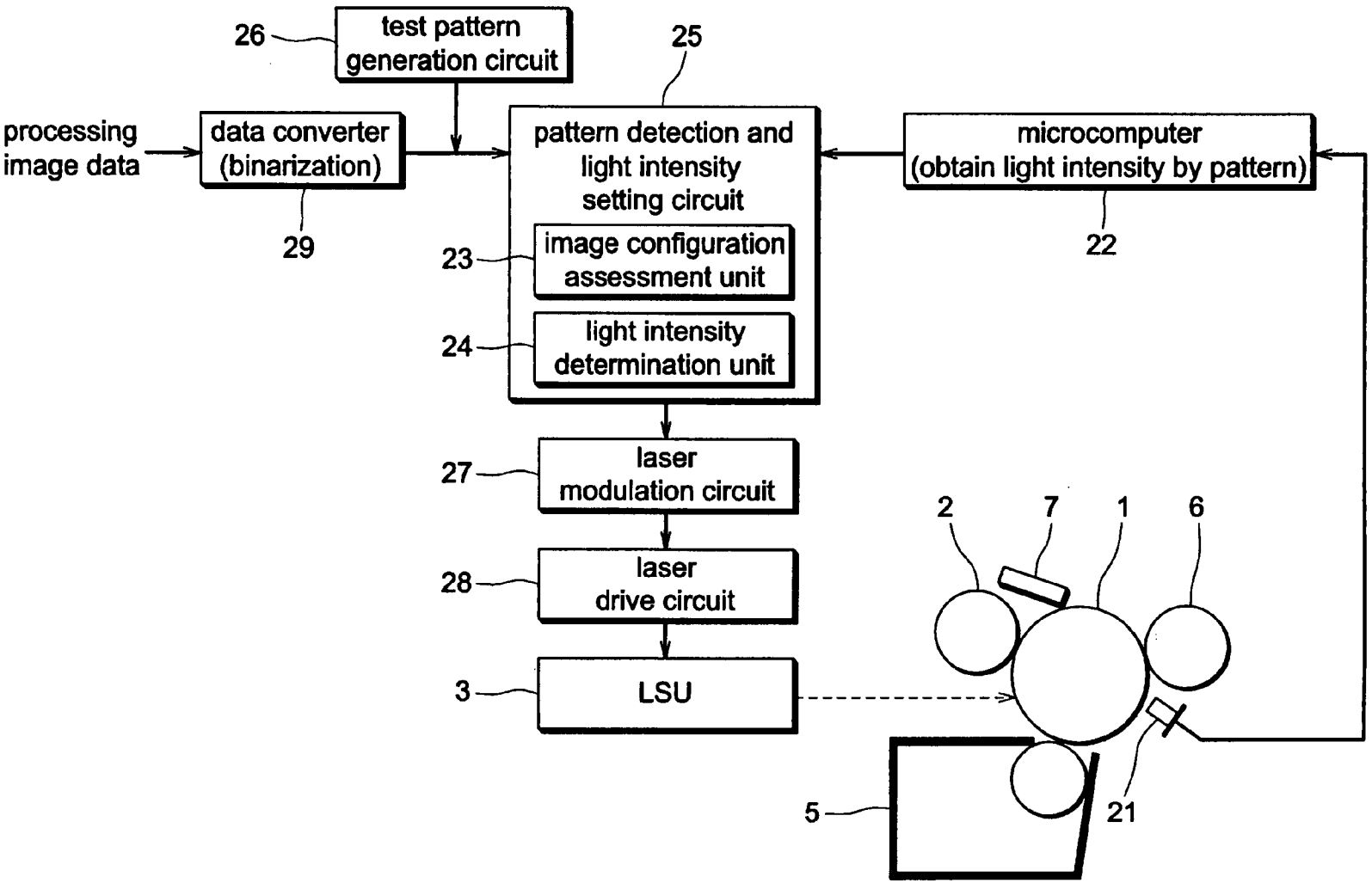
FIG. 2 is a block diagram illustrating a general configuration of an image density controller of the image formation apparatus of FIG. 1.

FIG. 2 is a block diagram illustrating a general configuration of an image density controller of the image formation apparatus of FIG. 1. The image density controller includes photo sensor 21 that detects density of toner image for each test pattern formed on photoconductor drum 1, microcomputer 22 that obtains optimum light intensity for each test pattern based on the detection result of photo sensor 21, and pattern detection and light intensity setting circuit 25 having image configuration assessment unit 23 that assesses image configuration per a predetermined assessment area unit of the processing image, and light intensity determination unit 24 that determines the light intensity for processing image based on the optimum light intensity of the test pattern chosen for the obtained image configuration.

The test pattern image data used during the process for obtaining optimum light intensity by microcomputer 22 is generated at test pattern generation circuit 26.

Light intensity data in pixel unit, being output from pattern detection and light intensity setting circuit 25 is transmitted to LSU 3 via laser modulation circuit 27 and laser drive circuit 28. Laser modulation circuit 27 controls pulse width modulation (PWM), in order to control lighting time of a light source per pixel unit according to the light intensity determined by pattern detection and light intensity setting circuit 25.

Figure 14:
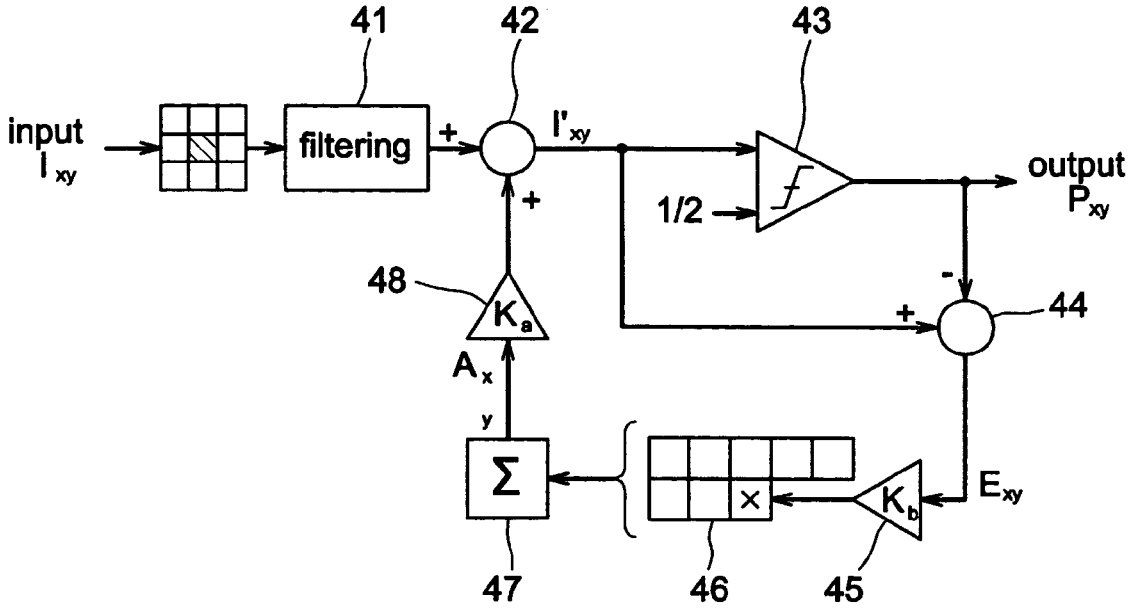
FIG. 14 is a block diagram illustrating a procedure of binary error diffusion by the image density controller of FIG. 2.

The image apparatus of the invention also includes data converter 29 that performs a binarization of processing image data that is configured with multi-level data having half tones. Prior to the image configuration assessment process at image configuration assessment unit 23, data converter 29 performs a binarization with the error diffusion method on the processing image data (FIG. 14).

Figure 3A:
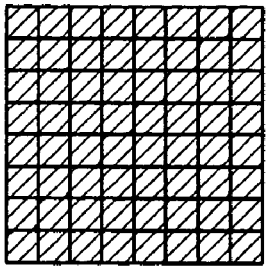
FIGS. 3A, 3B, and 3C illustrate test patterns used by the image density controller of FIG. 2.
Figure 3B:
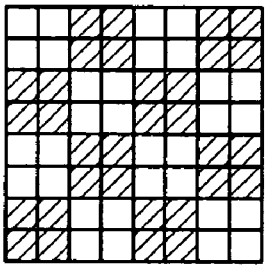
Figure 3C:
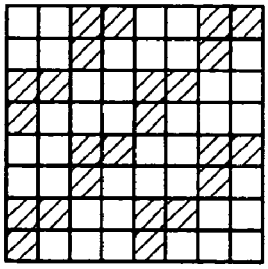

FIG. 3 illustrates test patterns used by the image density controller of FIG. 2. FIG. 3(A) shows an all black test pattern. FIG. 3(B) shows the first checkered flag test pattern having white and black regions alternatively, each having 4×4 pixels, that are regularly aligned. FIG. 3(C) shows the second checkered flag test pattern having each black pixel within a 4×4 pixel black region is converted into a white pixel.

The above mentioned test pattern is appropriate for evaluating toner image density, since the overall average density can be obtained from photo sensor 21. Especially, the sensor output of the all black test pattern can indicate the density according to the thickness of the toner layer. In addition, the sensor output of the checkered flag test pattern is appropriate for evaluating the toner image widths, since the sensor output of the checkered flag test pattern indicates a level of the brightness of the over all test pattern according to the ratio between the exposure surface of the photoconductor and toner image.

The second checkered flag test pattern has a bigger ratio of white pixels compared to the one of the first checkered flag test pattern, thereby having a brighter test pattern. Microcomputer 22 can selectively uses the appropriate pattern from these checkered flag test patterns having different back-and-white ratios, according to the characteristics of photo sensor 21. Therefore, it is possible to increase the dynamic range of photo sensor 21, i.e., to accurately identify the width of the toner image based on a test pattern (FIGS. 17 and 18).

Figure 4:
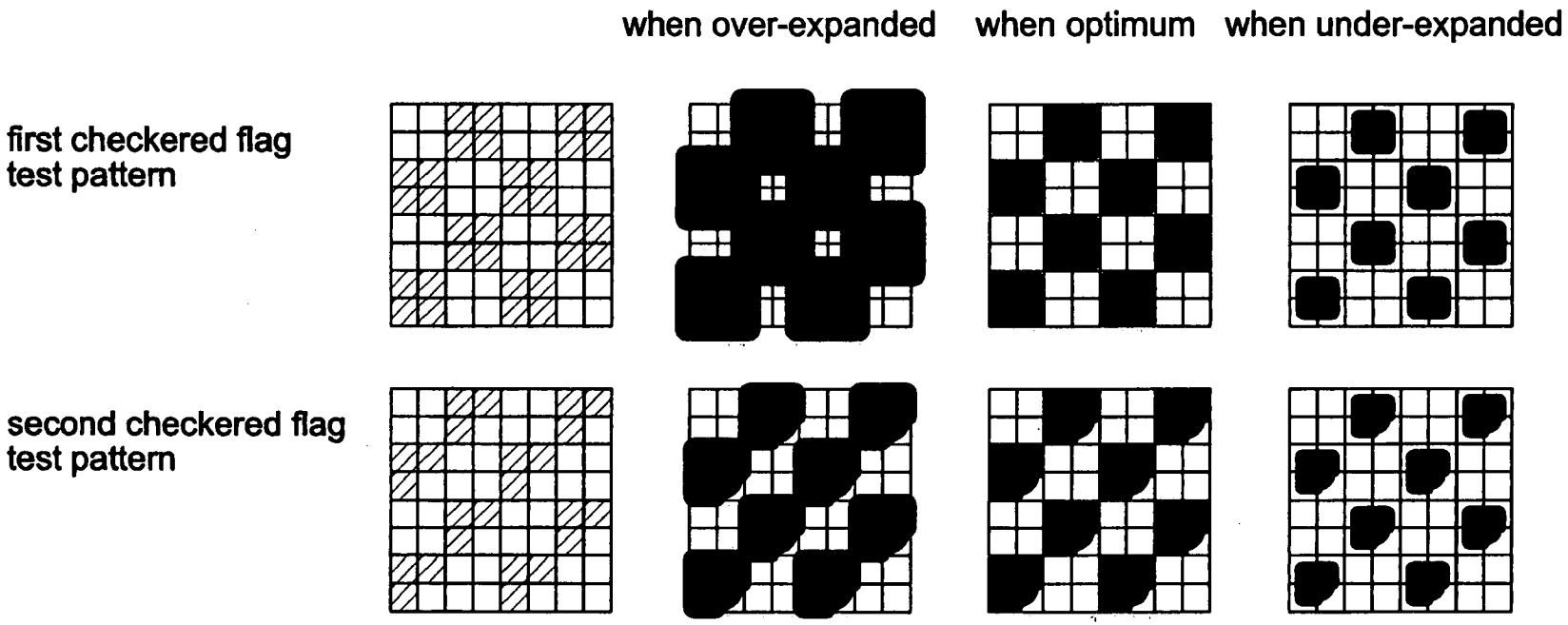
FIG. 4 illustrates toner image formations according to differences in light intensities using checkered flag test patterns of FIG. 3.

FIG. 4 illustrates toner image formations according to differences in light intensities using checkered flag test patterns of FIG. 3. When the light intensity is too strong, the toner image becomes over-expanded. When the light intensity is optimum, the toner image can realistically materialize the black and white pixels. When the light intensity is too small, the toner image becomes under-expanded. By detecting the toner image of these checkered flag patterns using photo sensor 21, it is possible to assess average width in the vertical, horizontal, and diagonal directions.

Figure 5:
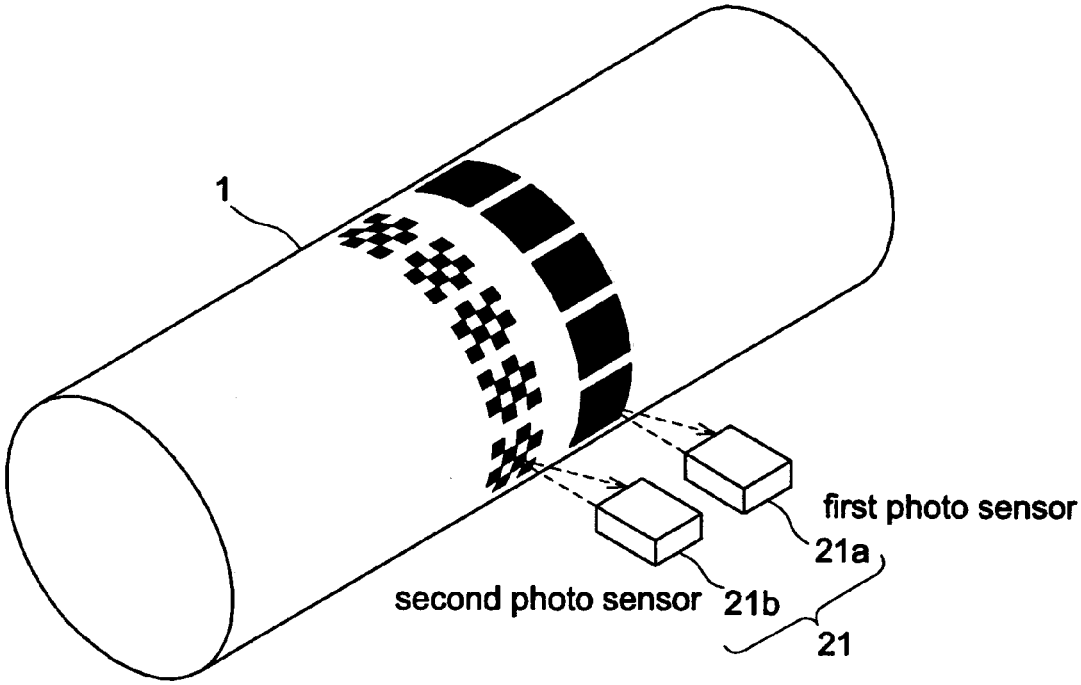
FIG. 5 is a perspective view of a schematic diagram illustrating how a test pattern is generated by the image density controller of FIG. 2.

FIG. 5 is a perspective view of a schematic diagram illustrating how a test pattern is generated by the image density controller of FIG. 2. In this example, first photo sensor 21*a* (that detects density of an all black test pattern) and second photo sensor 21*b* (that detects density of a checkered flag test pattern) are provided on photoconductor drum 1. Light-emitting elements of photo sensors 21*a* and 21*b* illuminate the test patterns on photoconductor drum 1. Then, the reflected light is received by light-intercepting elements.

The test pattern is generated at predetermined times by changing light intensity in plurality of stages, where photo sensors 21*a* and 21*b* detect density of plurality of toner images having different light intensities for each test pattern. Microcomputer 22 compares the obtained sensor output value with a predetermined output target value, so that an optimum light intensity that can achieve the output target value is calculated for each test pattern.

Figure 6:
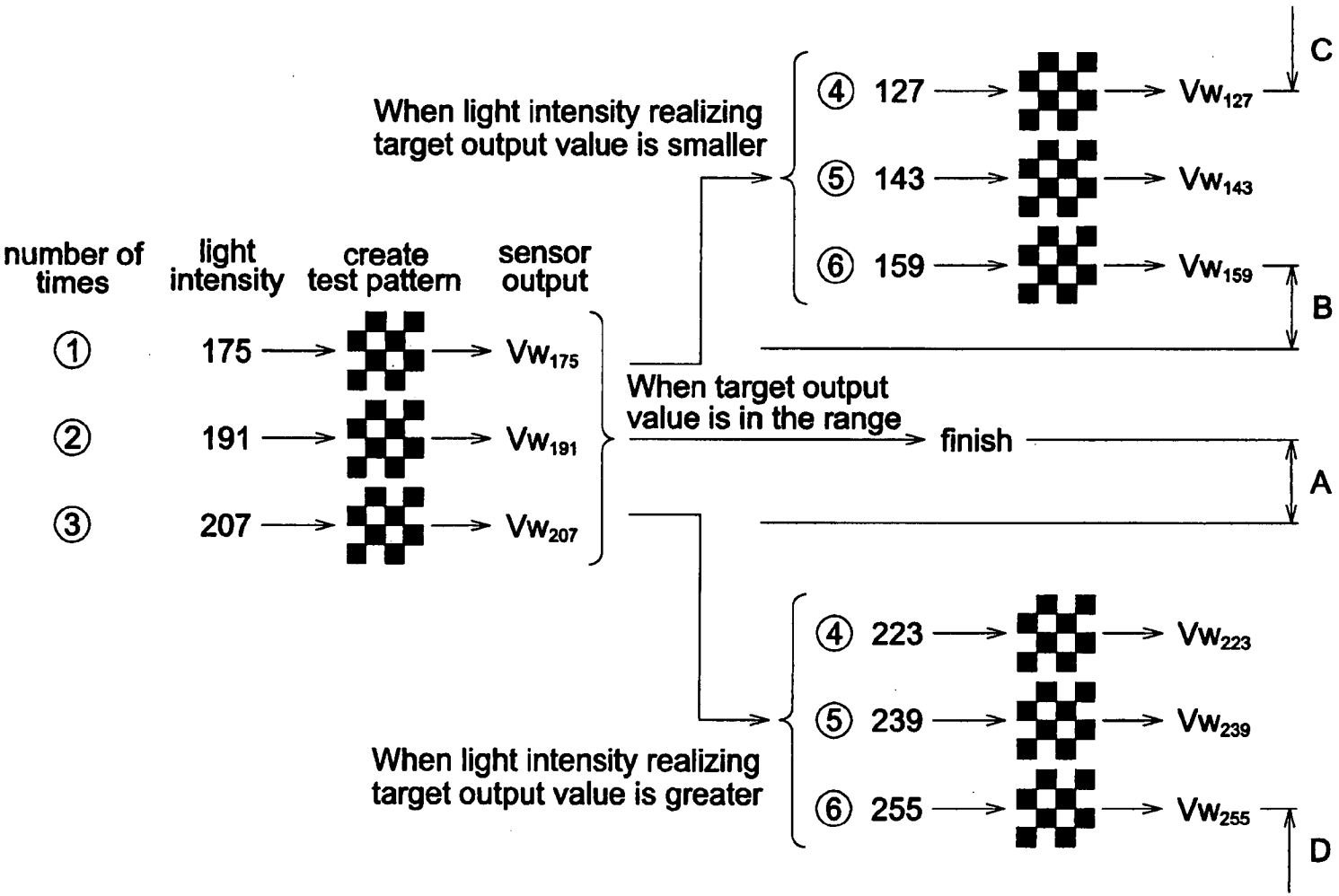
FIG. 6 illustrates a procedure of obtaining an optimum light intensity by the image density controller of FIG. 2.

FIG. 6 illustrates a procedure of obtaining an optimum light intensity by the image density controller of FIG. 2. In this example, a checkered flag test pattern is used. In the procedure of obtaining the optimum light intensity, firstly, three test patterns are generated having different light intensities in stages. For example, the testing light intensities are set at 175 (first time), 191 (second time), and 207 (third time). In this embodiment, the light intensities have 256 (0-255) multi-level data varieties.

When there is an output target value $Vw_{REF}$ (e.g., 2.1V) within the range of the first—third output values $Vw_{175}$, $Vw_{191}$, and $Vw_{207}$, the procedure is completed. Then, a light intensity (that can achieve output target value $Vw_{REF}$) is calculated, by a linear interpolation, from two of the output values (among $Vw_{175}$, $Vw_{191}$, and $Vw_{207}$) sandwiching output target value $Vw_{REF}$, and output target value $Vw_{REF}$. For example, as shown in "A" in the figure, when output target value $Vw_{REF}$ is between $Vw_{191}$ and $Vw_{207}$, light intensity (duty) is calculated as follows:

$$duty=191+16*|Vw_{191}-Vw_{REF}|/|Vw_{191}-Vw_{207}|$$

When there is no output target value $Vw_{REF}$ within the range of the first—third output values $Vw_{175}$, $Vw_{191}$, and $Vw_{207}$, the test pattern having a different light intensity is regenerated. When the light intensity that can achieve output target value $Vw_{REF}$ is smaller than the first—third test light intensities, the following fourth—sixth test light intensities are set as 127, 143, and 159, respectively, for example. When the light intensity that can achieve output target value $Vw_{REF}$ is greater than the first—third test light intensities, the following fourth—sixth test light intensities are set as 223, 239, and 255, respectively, for example. When there is output target value $Vw_{REF}$ within the range of the three output values $Vw_{127}$, $Vw_{143}$, and $Vw_{159}$ (or, $Vw_{223}$, $Vw_{239}$, and $Vw_{255}$), the light intensity (that can achieve output target value $Vw_{REF}$) is calculated by the linear interpolation, similar to the above-described procedure.

In addition, as shown in "B" in the figure, when there is output target value $Vw_{REF}$ within the range of the first—sixth output values $Vw_{175}$ and $Vw_{159}$, the light intensity (duty) that can achieve output target value $Vw_{REF}$ is calculated by the linear interpolation as follows:

$$duty=191+16*|Vw_{159}-Vw_{REF}|/|Vw_{159}-Vw_{175}|$$

In this embodiment, the test pattern is generated up to 6 times. When output target value $Vw_{REF}$ is greater than the maximum output value $Vw_{127}$, as shown in "C" in the figure, the maximum test light intensity 127 becomes the optimum light intensity. When output target value $Vw_{REF}$ is smaller than the minimum output value $Vw_{255}$, as shown in "D" in the figure, the minimum test light intensity 255 becomes the optimum light intensity.

Figure 12:
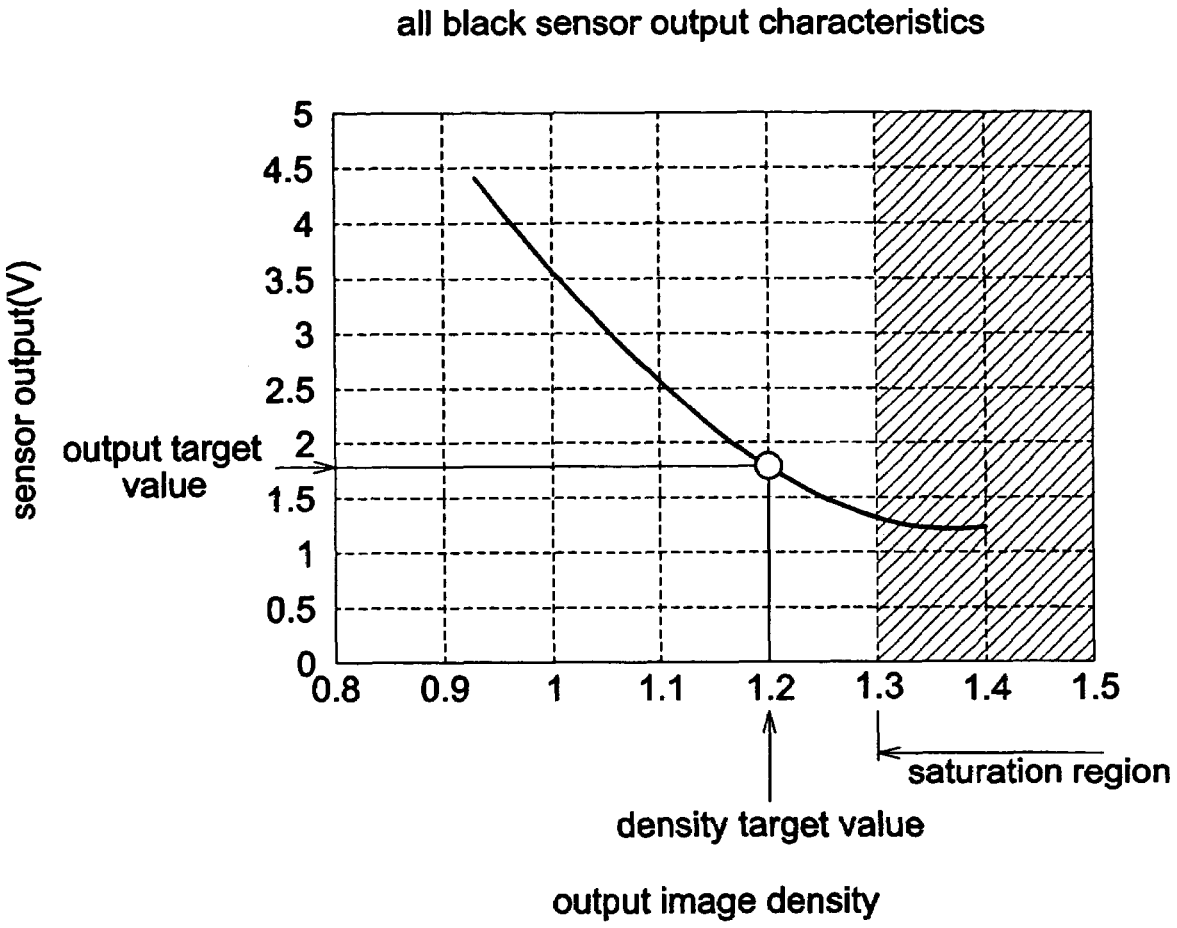
FIG. 12 illustrates a procedure of the image density controller of FIG. 2, when the sensor output is saturated.
Figure 13:
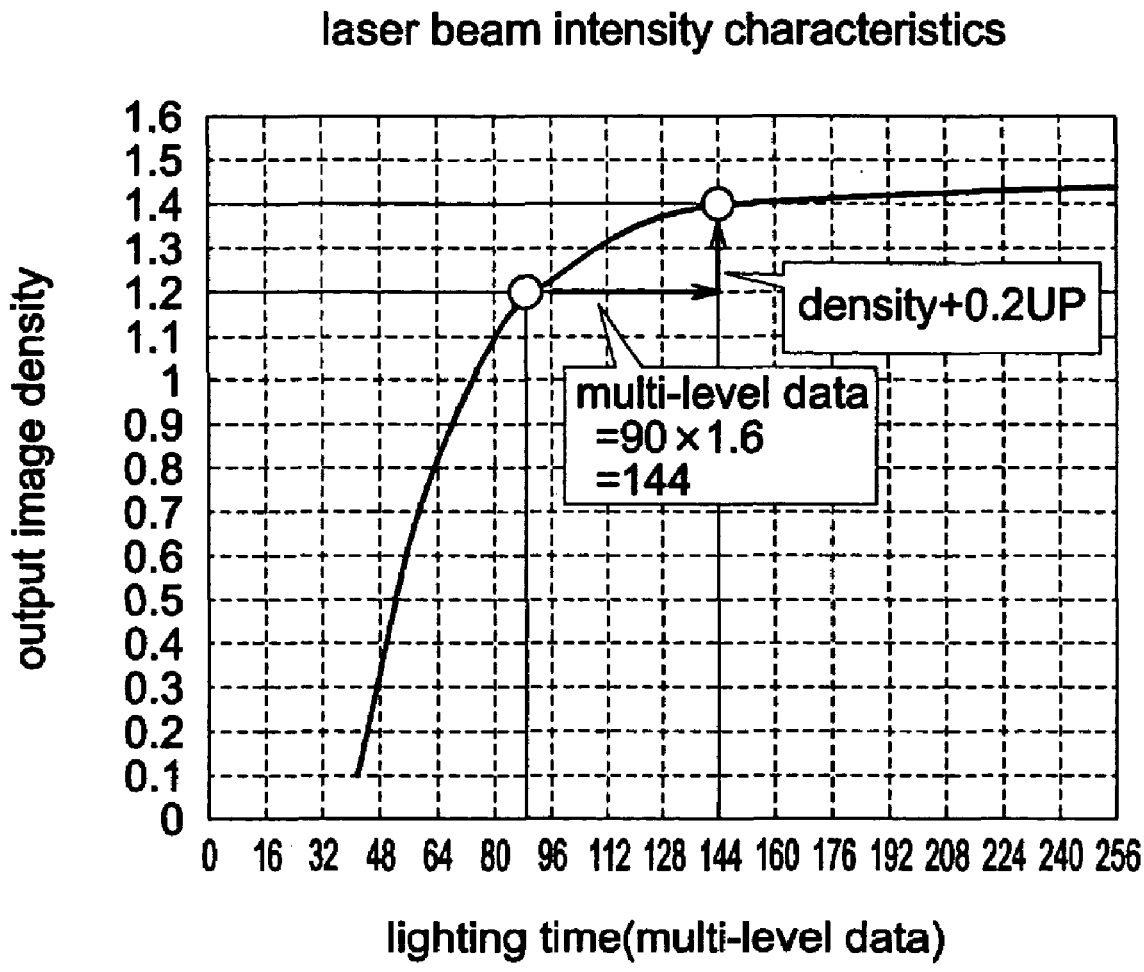
FIG. 13 illustrates another procedure of the image density controller of FIG. 2, when the sensor output is saturated.

Further, in case of using an all black test pattern, a light intensity that can achieve output target value $Vw_{REF}$ (e.g., 1.8V) is calculated similar to the above example of the checkered flag test pattern. In this case, the first—third test light intensities are set as 79, 95, and 111, respectively, for example. When the light intensity that can achieve output target value $Vw_{REF}$ is smaller than the first three test light intensities, the fourth—sixth test light intensities are set as 31, 47, and 63, respectively, for example. When the light intensity that can achieve output target value $Vw_{REF}$ is greater than the first three test light intensities, the fourth—sixth test light intensities are set as 127, 143, and 159, respectively, for example. Additionally, the test light intensities of the all black test pattern are smaller than the test light intensities of the checkered flag test pattern, because a process for sensor output saturation is performed (FIGS. 12 and 13).

Figure 7:
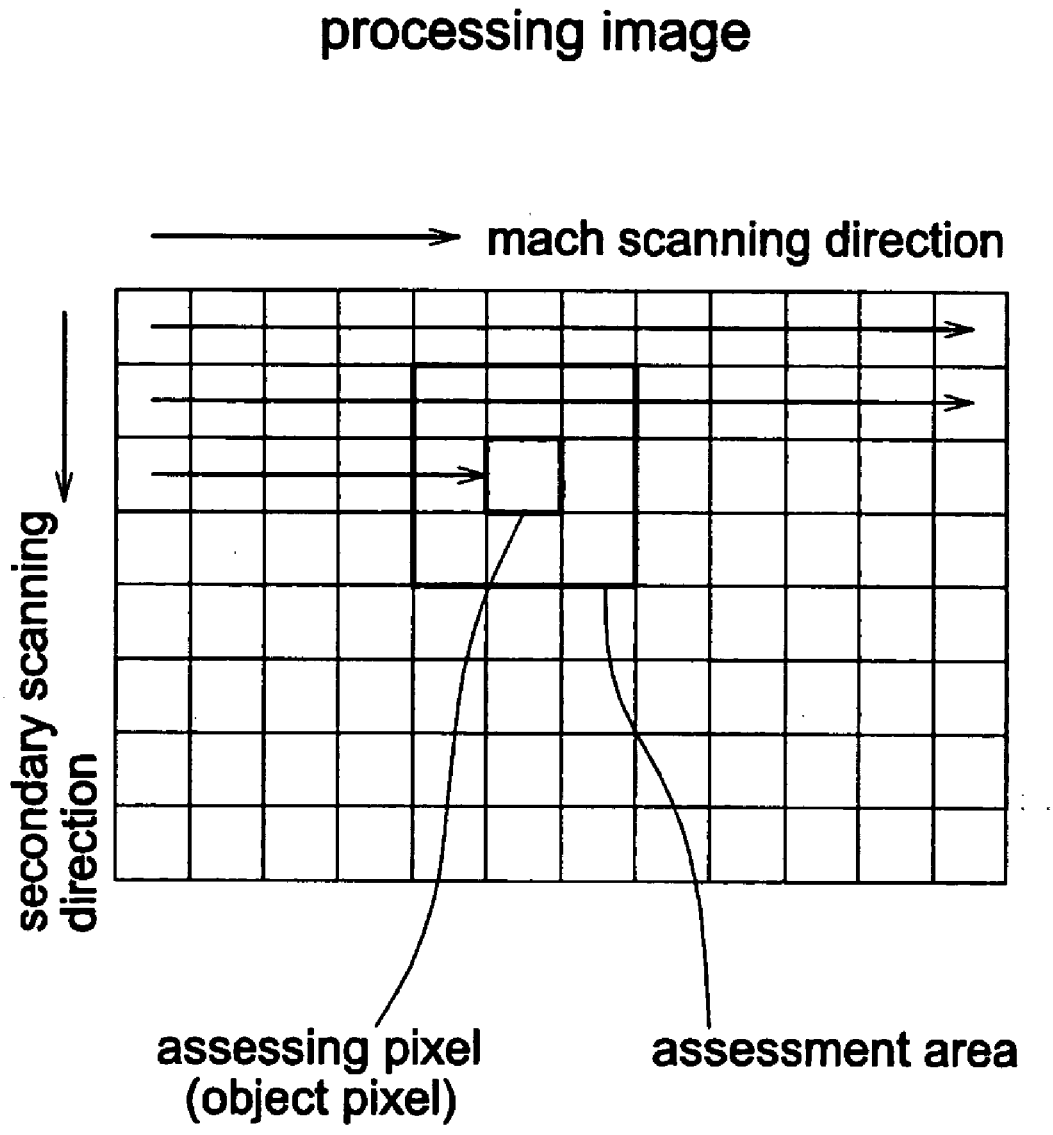
FIG. 7 illustrates a procedure of assessing image configuration by the image density controller of FIG. 2.

FIG. 7 illustrates a procedure of assessing image configuration by the image density controller of FIG. 2. Image configuration assessment unit 23 of pattern detection and light intensity setting circuit 25 of FIG. 2 assesses the image configuration per a predetermined assessment area within a processing image. In this embodiment, the image configuration is assessed per pixel, according to the appearance of surrounding black and white pixels within the assessment area. In particular, 3×3 pixels, i.e., a pixel for assessment (object pixel) plus 8 other surrounding adjacent pixels (above, below, right, left, and 4 diagonally faced ones) (total 9 pixels) are considered as the assessment area.

When the processing image data is input, image configuration assessment unit 23 assesses the image configuration per pixel, on one line of the main scanning direction. When the assessment for the line is completed, an adjacent line in the secondary scanning direction is assessed. This procedure is repeated until the entire processing image is assessed.

Figure 8:
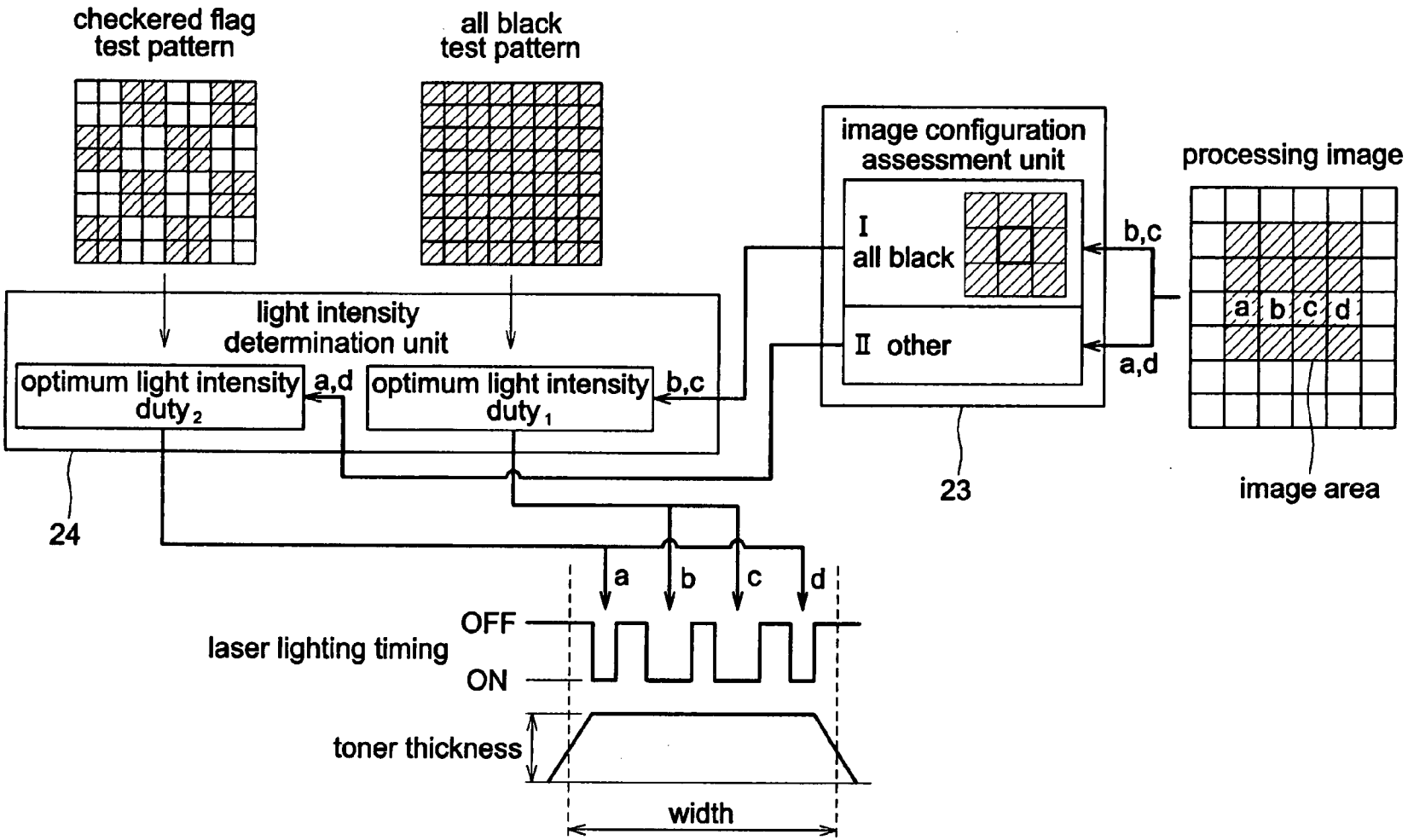
FIG. 8 illustrates a procedure of assessing image configuration and determining light intensity by the image density controller of FIG. 2.

FIG. 8 illustrates a procedure of assessing image configuration and determining light intensity by the image density controller of FIG. 2. Image configuration assessment unit 23 assesses whether the pixels of the assessment area are all black or else (not all black). Light intensity determination unit 24 determines the light intensity for each pixel from the optimum light intensity based on the various test patterns.

Pixels corresponding to all black configuration (the first image configuration) are located at the center of image area comprising black pixels, and thus are required to have high density for toner image, in order to prevent a problem that a part of black pixels falls out or the density of the pixels becomes low by low toner adhesion. Therefore, when the object pixel configures an all black configuration, light intensity is determined according to optimum light intensity ($duty_1$) of the all black test pattern, which is suitable for assessing the toner image density. In this example, pixels "b" and "c" on the processing image have an all black configuration.

Pixels corresponding to "other configuration" (mixed with white pixels within the assessment area) (the second image configuration) are located at a border of the image area. In order to prevent over-expanded line and character distortion, widths of toner image need to be controlled. Therefore, when the object pixel is considered to have the "other configuration", light intensity is determined according to optimum light intensity ($duty_2$) of the checkered flag test pattern, which is suitable for assessing the toner image widths. In this example, pixels "a" and "d" on the processing image have the "other configuration".

Accordingly, the PWM controls the laser lighting time, so that the laser lighting time for pixels "b" and "c" within the image area, is longer to have a higher density having a thicker toner image. At the edge of the image area, the laser lighting time for pixels "a" and "d" is shorter to control the width of the toner image.

Figure 9:
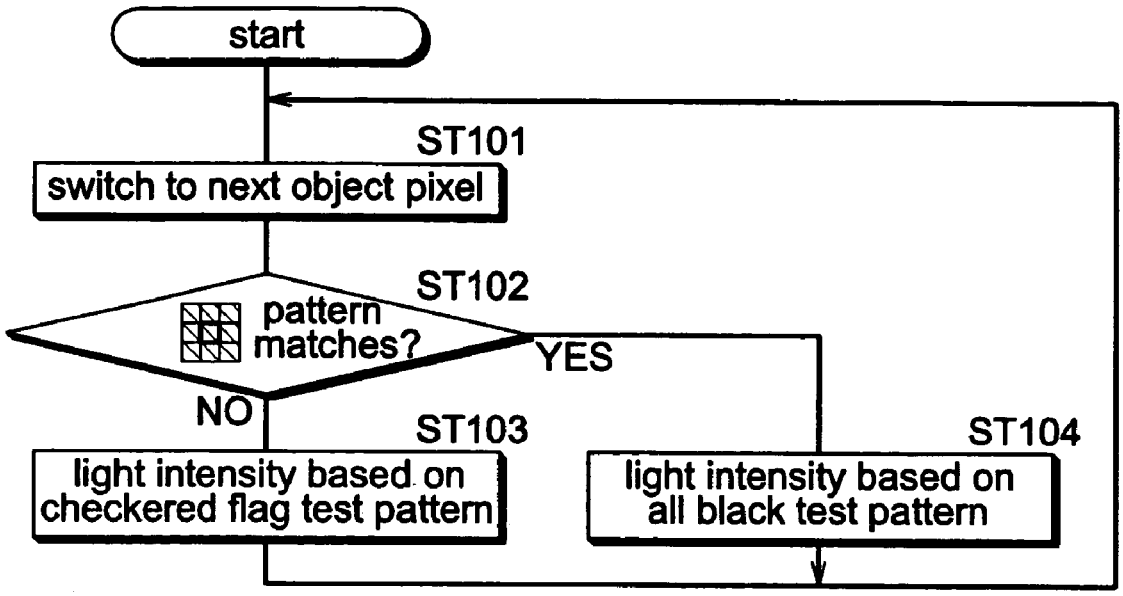
FIG. 9 is a flowchart illustrating the procedure of FIG. 8.

FIG. 9 is a flowchart illustrating the procedure of FIG. 8. At step 101, the object pixel is switched to the next pixel. At the following step 102, it is checked whether the pattern matches with the all black configuration. When it does not match, the control moves to step 103 to determine the optimum light intensity of the checkered flag test pattern as the light intensity of the object pixel. When it matches with the all black configuration, the control moves to step 104 to determine the optimum light intensity of the all black test pattern as the light intensity of the object pixel.

Figure 10:
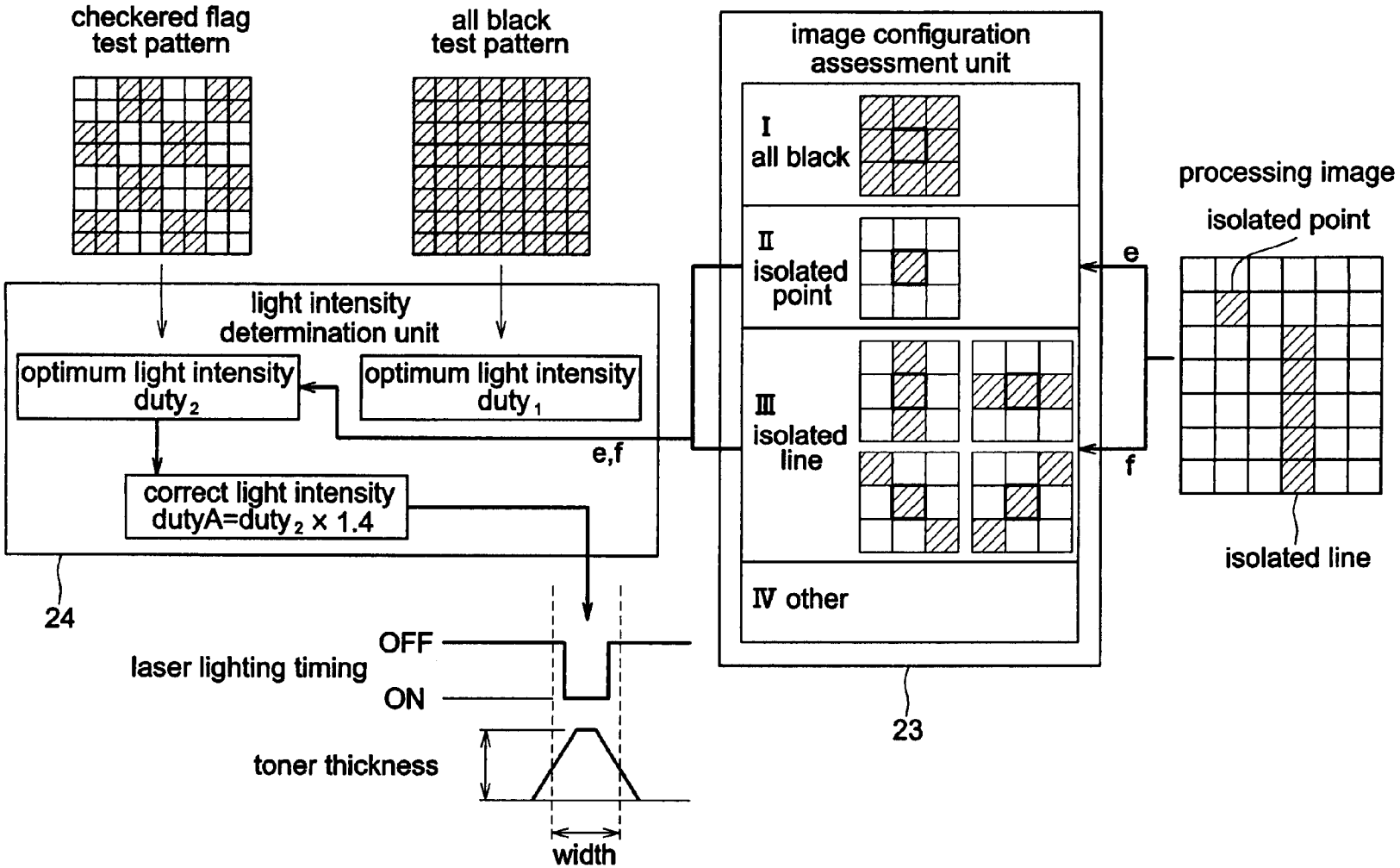
FIG. 10 illustrates another procedure of assessing image configuration and determining light intensity by the image density controller of FIG. 2.

FIG. 10 illustrates another procedure of assessing image configuration and determining light intensity by the image density controller of FIG. 2. In this example, four types of configurations (all black, isolated point, isolated line, and other) are provided for the assessment. The isolated point comprises a single black pixel (in the center) and 8 other adjacent pixels are all while pixels. The isolated line comprises a series of black pixels in a line. Two opposing pixels sandwiching the center black pixel are black pixels, and the two opposing pixels are configured a vertical, horizontal, or diagonal line, together with the center black pixel. All other adjacent pixels (6 pixels surrounding the line) must be white pixels.

When the object pixel configures an isolated point or an isolated line, it is necessary to control the overall width of the toner image, in order to reduce distortion of points and lines. Therefore, the light intensity is determined based on optimum light intensity $duty_2$ according to checkered flag pattern, which is suitable for evaluating the widths of the toner image. Optimum light intensity $duty_2$ is also correctively increased by a predetermined corrective factor K. In particular, optimum light intensity $duty_2$ is multiplied by corrective factor K (=1.4) in order to calculate the light intensity for the object pixel as follows:

$$duty=duty_2\times1.4$$

Accordingly, when the object pixel configures an isolated point or an isolated line, it is possible to prevent an over-expanded width of the toner image that is due to a relatively long laser lighting time, or an under-expanded width of toner image that leads to missing and/or blur finish.

Figure 11:
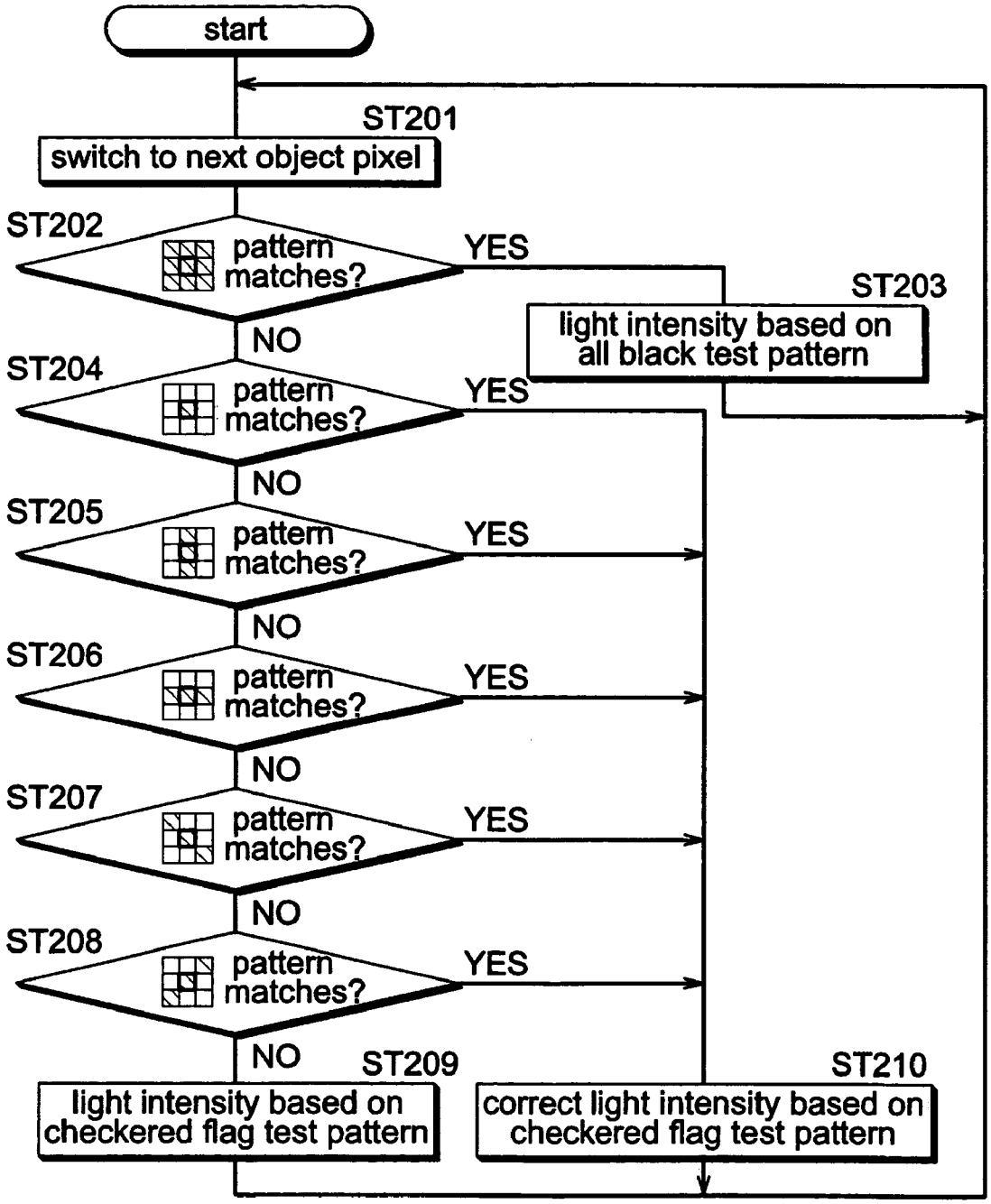
FIG. 11 is a flowchart illustrating the procedure of FIG. 10.

FIG. 11 is a flowchart illustrating the procedure of FIG. 10. In this example, at step 201, the object pixel is switched to the next pixel. At the following step 202, it is checked whether the pattern matches with the all black configuration. When it matches, the control moves to step 203 to determine the optimum light intensity of the all black test pattern as the light intensity of the object pixel. When it does not match, the control moves to step 204 to check whether the object pixel configures an isolated point or an isolated line pattern (steps 205–208). When none of the patterns matches with the object pixel, the control moves to step 209 to determine the optimum light intensity of the checkered flag test pattern as the light intensity of the object pixel. When one of the patterns matches with the object pixels, the controls moves to step 210 to correct the optimum light intensity of the checkered flag test pattern to calculate the light intensity of the object pixel.

FIGS. 12 and 13 illustrate a procedure of the image density controller of FIG. 2, when the sensor output is saturated. When an all black test pattern is used, the output of photo sensor 21*a* sometimes becomes saturated, hindering accurate density detection. Therefore, microcomputer 22 calculates an optimum light intensity by modifying the output target value of photo sensor 21 into a value outside of the saturation region. Then, light intensity determination unit 24 corrects the optimum light intensity (obtained by microcomputer 22) using a predetermined factor, and determines the desired light intensity.

In the example shown in FIG. 12, the output from photo sensor 21 becomes saturated at image density level 1.3. Since image density level 1.4 cannot be detected, it is impossible to perform an appropriate control at the level. Therefore, in order to calculate an optimum light intensity, the density target value is corrected into a level lower than the saturation region of the sensor output (e.g., into level 1.2). Then, the corresponding output value 1.8 becomes the output target value $Vw_{REF}$.

Next, as shown in FIG. 13, the above-calculated optimum light intensity is modified so that the density of the all black test pattern becomes 1.4. In particular, the light intensity (duty) of the object pixel is calculated by multiplying the optimum light intensity $duty_1$ by corrective factor K=1.6 as follows:

$$duty=duty_1\times1.6$$

FIG. 14 is a block diagram illustrating a procedure of binary error diffusion by the image density controller of FIG. 2. At data converter 29, filtering unit 41 filters input signal $I_{xy}$ (comprising multilevel data of object pixel) and adder 42 adds an error weighted average $A_{xy}$ (processed before the object pixel) to the signal in order to obtain multilevel signal $I'_{xy}$. Then, binarization unit 43 performs a binarization on $I'_{xy}$ by comparing with a predetermined binarization threshold value to obtain output signal $P_{xy}$. Then, based on the binary signal $P_{xy}$ and multilevel signal $I'_{xy}$ of the object pixel, subtracter 44 calculates a binarization error $E_{xy}$, which will be multiplied by factor $K_b$ by multiplier 45 and stored in error memory 46. Weighting adder 47 refers to error memory 46 and obtains weighted average $A_{xy}$ of peripheral pixel error $E_{xy}$. Weighted average $A_{xy}$ is multiplied by factor $K_a$ by multiplier 48 and added by adder 42 for the next object pixel.

Figure 15:
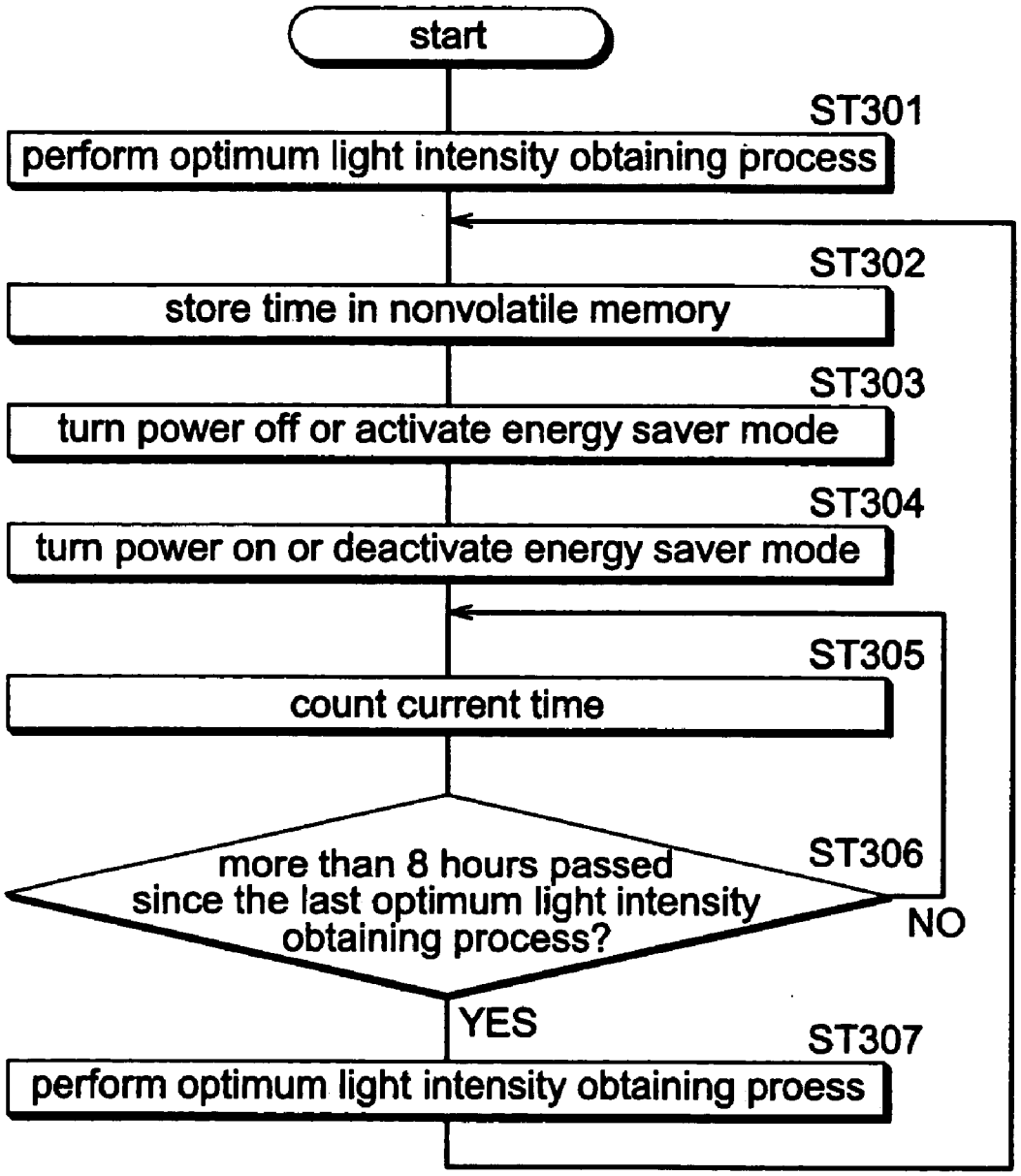
FIG. 15 is a flowchart illustrating operation timing to obtain an optimum light intensity by the image density controller of FIG. 2.

FIG. 15 is a flowchart illustrating operation timing to obtain an optimum light intensity by the image density controller of FIG. 2. Microcomputer 22 performs an optimum light intensity obtaining process using generated test pattern every predetermined time interval (e.g., every 8 hours), since the last optimum light intensity obtaining process.

First, at step 301, an optimum light intensity obtaining process is performed. At step 302, the performing time is stored in a nonvolatile memory. Then, at step 303, the power is turned off, or an energy saver mode is activated. When the power is turned on or the energy saver mode is deactivated at step 304, the current time is counted at step 305. At the following step 306, it is determined whether 8 hours or more have passed since the last optimum light intensity obtaining process. When 8 hours or more have passed, another optimum light intensity obtaining process is performed at step 307, and control returns to step 302. When 8 hours or more have not passed, the control returns to step 305.

Accordingly, the process for obtaining optimum light intensity is performed at an appropriate timing in accordance with the changes in toner charge amount. Further, it is possible to prevent excess use of toner, since test patterns are not generated every time the power is supplied to the apparatus (e.g., when the energy saver mode is activated) and performs the process for obtaining optimum light intensity.

Figure 16A:
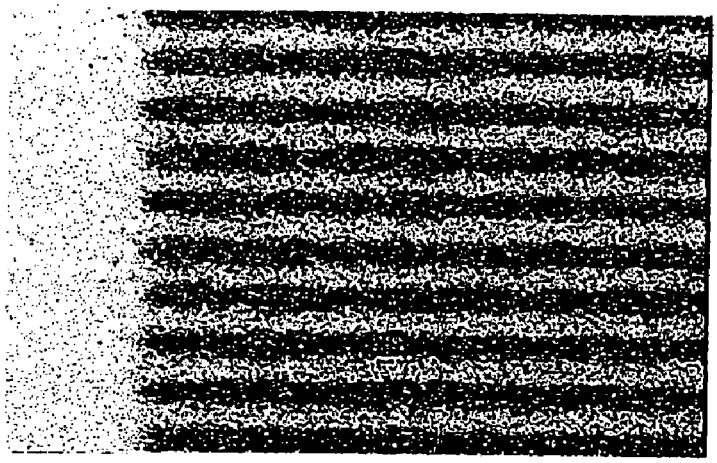
FIGS. 16A and 16B illustrate actual generated toner images.
Figure 16B:
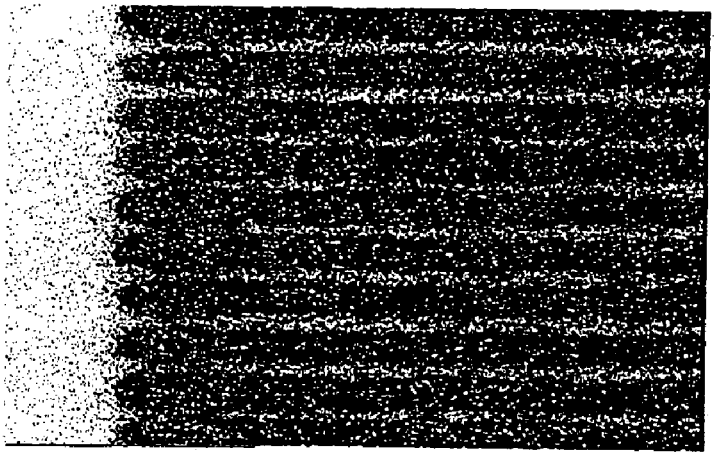

FIG. 16 illustrates an actually generated toner image. This is to examine whether a 2 dot line pairs (2 pixel width lines formed every 2 pixels interval) can be resolved as a line. As shown in (B), when the image density control of the present invention is not performed, the lines are distorted and it is difficult to identify them as lines. However, as shown in (A), when the image density control of the present invention is performed, the line distortion is appropriately controlled and the lines can be clearly identified.

Figure 17A:
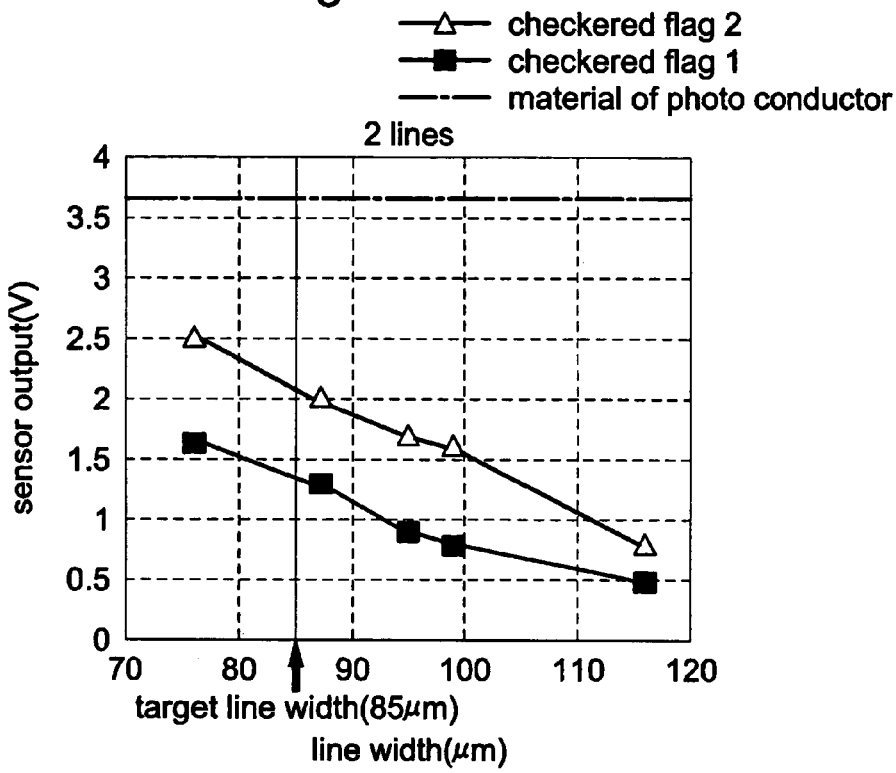
FIGS. 17A and 17B illustrate a procedure of improving the dynamic range of the checkered flag test patterns.
Figure 17B:
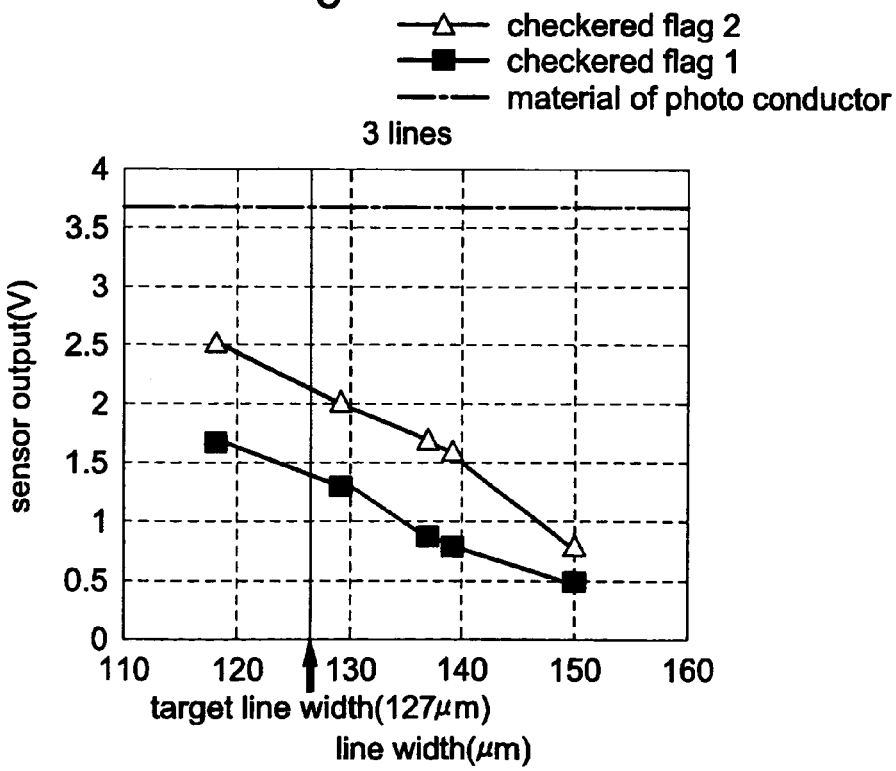
Figures 18, 19:
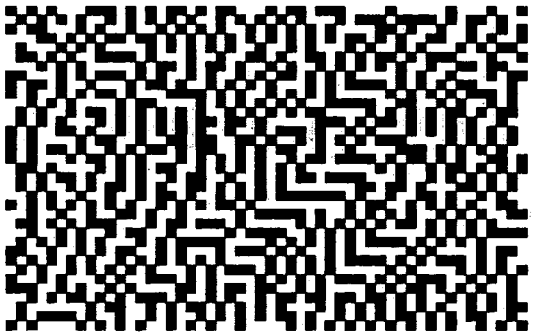
FIG. 18 illustrates differences in dynamic ranges of various checkered flag test patterns.
FIG. 19 illustrates a partially enlarged image obtained from a binary error diffusion of half-tone image data.

FIG. 17 illustrates a procedure of improving the dynamic range of the checkered flag test patterns. FIG. 18 illustrates differences in dynamic ranges of various checkered flag test patterns. In case of 2 lines (85 μm (600dpi) width) shown in FIG. 17(A), the sensor output is 1.3V for the first checkered flag test pattern, and 2.1 for the second checkered flag test pattern. Therefore, the second checkered flag test pattern has a higher value. In case of 3 lines shown in FIG. 17(B), the similar effect can be seen.

Accordingly, compared to the first checkered flag test pattern, the second checkered flag test pattern uses the sensor at a higher output value region. Thus, as shown in FIG. 18, compared to the first checkered flag test pattern, the second checkered flag test pattern has a wider dynamic range and raises the level of detection accuracy of the sensor.

Figure 20A:
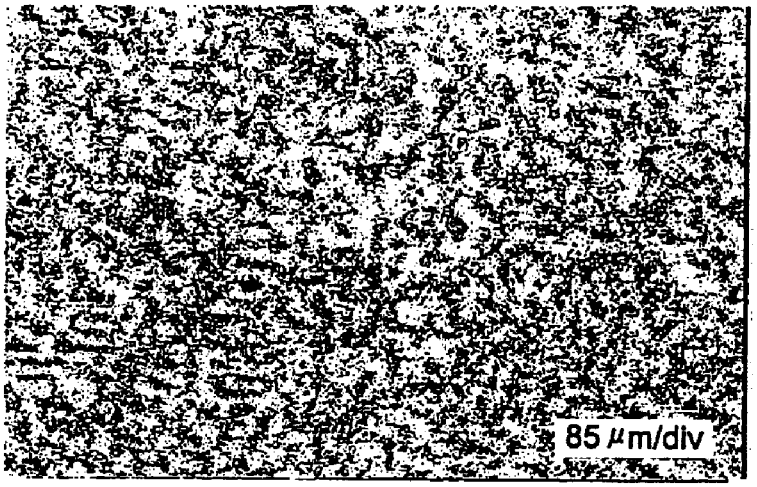
FIGS. 20A and 20B illustrate an actual generated toner images.
Figure 20B:
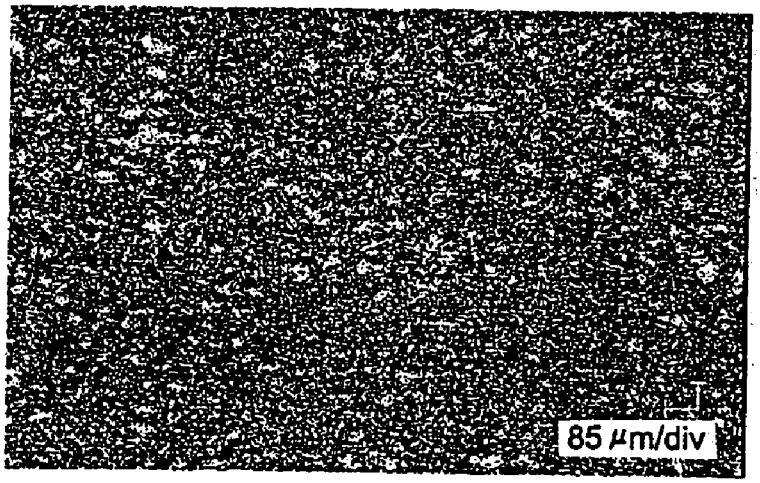

FIG. 19 illustrates a partially enlarged image obtained from a binary error diffusion of half-tone image data. FIG. 20 illustrates an actual generated toner images. In FIG. 20(A), toner widths are appropriately corrected by the image density control including the binary error diffusion of the present invention, showing that the original data pattern obtained by the binary error diffusion is realized accurately by the toner image.

Figure 21:
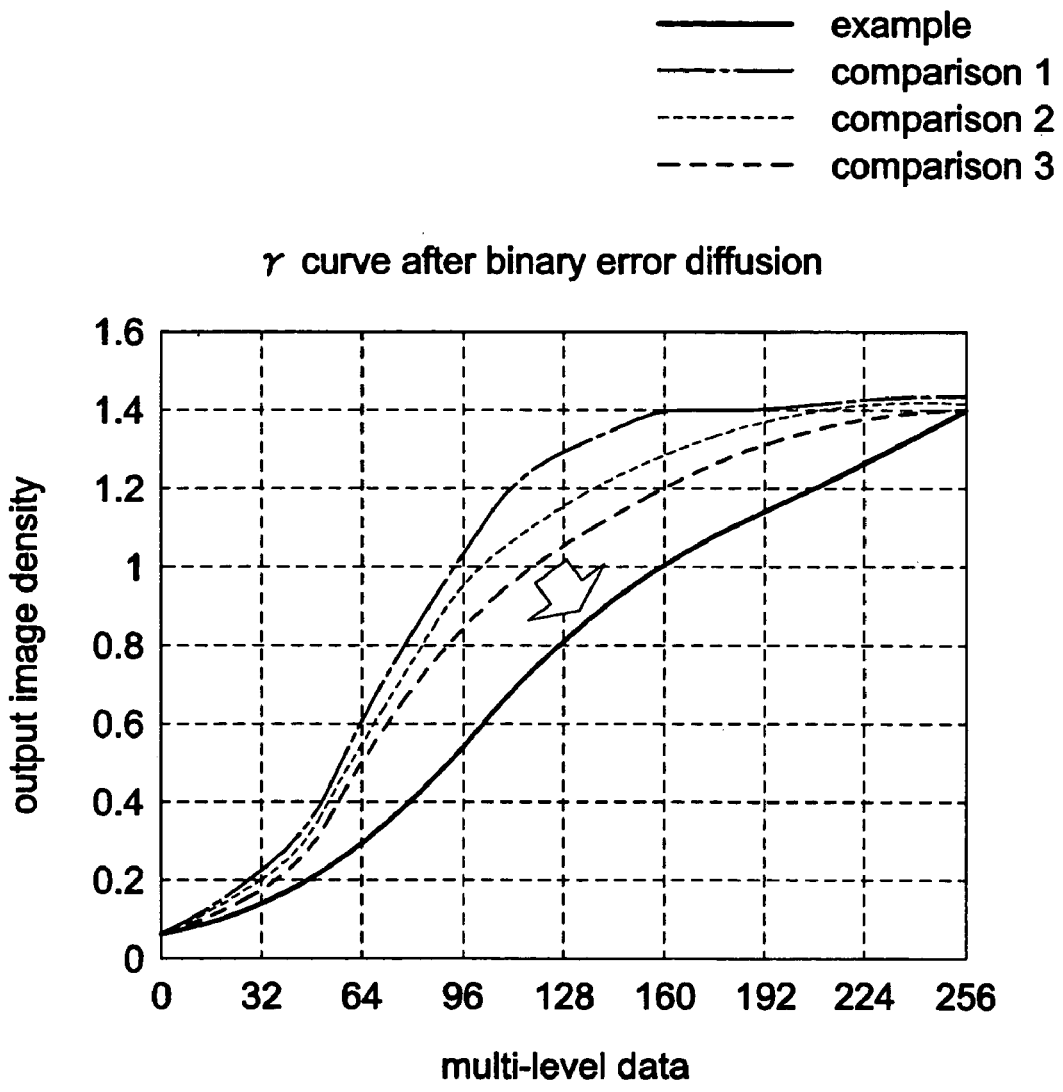
FIG. 21 illustrates changes in output image density of a half-tone data having 256 gradations.

FIG. 21 illustrates changes in output image density of a half-tone data having 256 gradations. When the image density control including the binary error diffusion is not performed (e.g., comparisons 1, 2, and 3), γ curve is affected by the changes in environment and time. However, when the image density control including the binary error diffusion of the present invention is performed, the incline of the γ curve becomes smaller and has stable characteristics similar to linear, indicating that the present invention is superior in tone reproduction for half tone.

In addition, the present invention is not limited to monochrome images, but also can be applied to color images. In such a case, the above-mentioned black pixels can be replaced with color pixels that can apply toner of certain color. According to the light amount of each color, the toner application amount can be controlled.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

This application is based on the Japanese Patent Application No. 2003-082523 filed on Mar. 25, 2003, entire content of which is expressly incorporated by reference herein.

What is claimed is:

1. An image density control apparatus for an image forming apparatus comprising;

a memory configured to store test pattern data, the test pattern data being configured for detecting a density of image data formed on a photo conductor from which a latent image is transferred onto a recording medium;

a laser unit configured to form a plurality of test patterns on the photo conductor by utilizing a plurality of first laser powers based on the test pattern data stored in the memory;

a detector configured to illuminate each test pattern formed on the photo conductor by the plurality of the first laser powers, to receive each light intensity reflected by the test patterns, and to provide output values corresponding to each received light intensity, the output values defining a first range of output values;

a controller configured to compare each output value with a first predetermined value;

the controller further configured to determine a laser power to be used based on the first predetermined value, when the first predetermined value falls within the first range of the output values.

2. The image density control apparatus for the image forming apparatus according to claim 1, wherein the laser power to be used is calculated, by a linear interpolation, from the first predetermined value and two output values closest to the first predetermined value.

3. The image density control apparatus for the image forming apparatus according to claim 2, wherein the laser unit, when the first predetermined value does not fall within the first range of the output values, forms a plurality of test pattern on the photo conductor by utilizing a plurality of second laser powers, the plurality of the second laser powers being lower than the plurality of the first laser powers;

the detector illuminates each test pattern formed on the photo conductor by the plurality of the second laser powers, receives each light intensity reflected by the test pafferns, and provides output values corresponding to each received light intensity, the output values defining a second range of output values;

the controller compares each output value with a second predetermined value, the second predetermined value being lower than the first predetermined value;

the controller further determines a laser power to be used based on the second predetermined value, when the second predetermined values falls within the second range of the output values.

4. The image density control apparatus for the image forming apparatus according to claim 3, wherein the laser unit, when the first predetermined value does not fall within the first range of the output values, forms a plurality of test patterns on the photo conductor by utilizing a plurality of third laser powers, the plurality of the third laser powers being higher than the plurality of the first laser powers;

the detector illuminates each test pattern formed on the photo conductor based on the plurality of the third laser powers, receives each light intensity reflected by the test patterns, and provides output values corresponding to each received light intensity, the output values defining a third range of output values;

the controller compares each output value with a third predetermined value, the third predetermined value being higher than the first predetermined value;

the controller further determines a laser power to be used based on the third predetermined value, when the third predetermined values falls within the third range of the output values.

5. The image density control apparatus for the image forming apparatus according to claim 1, wherein the test pattern data comprises data related to at least two types of test patterns, one type of test pattern being an all black test pattern, and another type of test pattern being a checkerboard test pattern having white regions and black regions;

the laser unit forms the plurality of test patterns based on each of the types of test-patterns so that the controller can determine the laser power to be used based on each of the types of test patterns.

6. The image density control apparatus for the image forming apparatus according to claim 5, wherein at least two types of checkerboard test-patterns are utilized as the checkerboard test pattern, a first checkerboard test pattern having equal amounts of white and black regions, and a second checkerboard test pattern having more white regions than black regions.

7. The image density control apparatus for the image forming apparatus according to claim 5, further comprising an image configuration determiner configured to determine whether pixels which are to be formed by the laser unit, are all black or not all black, wherein the controller selects the determined laser power based on the all black test pattern when the pixels are all black, and selects the determined laser power based on the test checkerboard pattern when the pixels are not all black.

8. The image density control apparatus for the image forming apparatus according to claim 7, wherein, when the pixels formed by the laser unit, comprise at least one of an isolated point and an isolated line, the controller modifies the determined laser power by utilizing a predetermined corrective factor.

9. The image density control apparatus for the image forming apparatus according to claim 7, wherein the controller controls a turning ON time of a laser of the laser unit, per pixel, based on the laser power selected by the controller.

10. The image density control apparatus for the image forming apparatus according to claim 7, wherein, when pixels formed by the laser unit comprise multi-valued data, the controller transforms the multi-valued data into binary data by utilizing a binary error diffusion procedure before the image configuration determiner determines whether pixels which are to be formed by the laser unit are all black or are not all black.

11. The image density control apparatus for the image forming apparatus according to claim 5, wherein the detector comprises a photo sensor, and when the test-pattern is an all black test pattern and the photo sensor can be saturated by reflected light from the test-pattern, the controller lowers an output power of the photo sensor, detects an image data density formed by the lowered output power of the photo sensor and modifies the detected image data destiny so as to correspond to an image data destiny which the controller would obtain if the controller did not lower the output power of the photo sensor.

12. The image density control apparatus for the image forming apparatus according to claim 1, wherein the controller re-selects the proper laser power at predetermined time intervals.

13. The image density control apparatus according to claim 1, wherein the photoconductor comprises an electrostatic photoconductor.

14. The image processing apparatus according to claim 1, wherein, when the detector can be saturated by reflected light of the test pattern, the controller lowers an output power of the detector and modifies the detected image data density so as to correspond to an image data density which the controller would obtain if the controller did not lower the output power of the detector.

15. An image forming apparatus in which a latent image formed on a photoconductor is transferred onto a recording medium, the apparatus comprising;

a memory configured to store test pattern data, the test pattern data being configured for detecting a density of image data formed on the photo conductor;

a laser unit configured to form a plurality of test patterns on the photo conductor by utilizing a plurality of first laser powers based on the test pattern data stored in the memory;

a detector configured to illuminate each test pattern formed on the photo conductor by the plurality of the first laser powers, to receive each light intensity reflected by the test patterns, and to provide output values corresponding to each received light intensity, the output values defining a first range of output values;

a controller configured to compare each output value with a first predetermined value;

the controller further configured to determine a laser power to be used based on the first predetermined value when the first predetermined values falls within the first range of the output values.

16. The image forming apparatus according to claim 15, wherein the laser unit, when the first predetermined value does not fall within the first range of the output values, forms a plurality of test patterns on the photo conductor by utilizing a plurality of second laser powers, the plurality of the second laser powers being lower than the plurality of the first laser powers;

the detector illuminates each test pattern formed on the photo conductor by the plurality of the second laser powers, receives each light intensity reflected by the test patterns, and provides output values corresponding to each received light intensity, the output values defining a second range of output values;

the controller compares each output value with a second predetermined value, the second predetermined value being lower than the first predetermined value;

the controller further determines a laser power to be used based on the second predetermined value, when the second predetermined values falls within the second range of the output values.

17. The image forming apparatus according to claim 16, wherein the laser unit, when the first predetermined value does not fall within the first range of the output values, forms a plurality of test patterns on the photo conductor by utilizing a plurality of third laser powers, the plurality of the third laser powers being higher than the plurality of the first laser powers;

the detector illuminates each test pattern formed on the photo conductor by the plurality of the third laser powers, receives each light intensity reflected by the test patterns, and provides output values corresponding to each received light intensity, the output values defining a third range of output values;

the controller compares each output value with a third predetermined value, the third predetermined value being higher than the first predetermined value;

the controller further determines a laser power to be used based on the third predetermined value, when the third predetermined values falls within the third range of the output values.

18. The image density control apparatus for the image forming apparatus according to claim 15, wherein the test pattern data comprises data related to at least two types of test-patterns, one type of test-pattern being an all black test pattern, and another type of test-pattern being a checkerboard test pattern having white regions and black regions;

the laser unit forms the plurality of test patterns based on each of the types of test-patterns so that the controller can determine the laser power to be used based on each of the types of test-patterns.

19. The image density control apparatus for the image forming apparatus according to claim 18, wherein at least two types of checkerboard test-patterns are utilized as the checkered flag test pattern, a first checkerboard test pattern having equal amounts of white and black regions, and a second checkerboard test pattern having more white regions than black regions.

20. The image density control apparatus for the image forming apparatus according to claim 18, further comprising an image configuration determiner configured to determine whether pixels which are to be formed by the laser unit, are all black or not all black, wherein the controller selects the determined laser power based on the all black test pattern when the pixels are all black, and selects the determined laser power based on the checkerboard test pattern when the pixels are not all black.

21. The image forming apparatus according to claim 15, wherein the photoconductor comprises an electrostatic photoconductor.

22. The image forming apparatus according to claim 15, wherein, when the detector can be saturated by reflected light of the test pattern, the controller lowers an output power of the detector and modifies the detected image data density so as to correspond to an image data density which the controller would obtain if the controller did not lower the output power of the detector.

23. An image processing apparatus in which an image formed on a photoconductor is developed and transferred to a recording medium, the image processing apparatus comprising;

a photo conductor;

an exposure device configured to form an image on said photo conductor;

a processor configured to process an input image;

a memory configured to store a test pattern data;

a detector configured to detect a density of the image on the photoconductor;

a first controller configured to control said exposure device to form a test pattern image according to the test pattern data on said photoconductor, to control said detector to detect the density of the test pattern image, and to determine a parameter for controlling said exposure device based on the detected density of the test pattern image; and a second controller configured to determine an attribute of the input image processed by said processor, and to control said exposure device based on the attribute and the parameter, to form the image on the photoconductor, wherein said first controller controls said exposure device to form the test pattern image on said photoconductor by a first light intensity, a second light intensity greater than the first light intensity, and a third light intensity greater than the second light intensity, and determines the parameter based on the second light intensity and a predetermined value, when the predetermined value is between a first density of the developed latent image formed with the first light intensity and a third density of the developed latent image formed with the third light intensity.

24. The image processing apparatus according to claim 23, wherein the first controller determines the parameter based on the second light intensity, the first density, a second density of the developed latent image formed with the second light intensity, and the predetermined value, when the predetermined value is between the first density and the second density.

25. The image processing apparatus according to claim 23, wherein the first controller determines the parameter based on the second light intensity, a second density of the developed latent image formed with the second light intensity, the third density and the predetermined value, when the predetermined value is between the second density and the third density.

26. An image processing apparatus in which an image, formed on a photoconductor, is developed and transferred to a recording medium, the image processing apparatus comprising;

a photo conductor;

an exposure device configured to form latent image on said photoconductor;

a processor configured to process an input image;

a determiner configured to determine an attribute of input image data;

a memory configured to store a first test pattern data and a second pattern data;

a detector configured to detect a density of the image on the photoconductor;

a first controller configured to control said exposure device to form, on said photoconductor, a first test pattern image according to the first test pattern data and a second test pattern image according to the second pattern data, to control said detector to detect a first density of the first test pattern image and a second density of the second test pattern image, and to determine a first parameter based on the first density and a second parameter based on the second density; and a second controller configured to determine an attribute of the input image processed by said processor, and to control said exposure device to form the input image on said photoconductor;

wherein, when the attribute of the input image is a first attribute, said second controller controls said exposure device based on the first parameter to form the input image on said photoconductor, and when the attribute of the input image is a second attribute, said second controller controls said exposure device based on the second parameter to form the input image on said photoconductor.

27. The image processing apparatus according to claim 26, wherein the first attribute indicates that the input image is an all black image and the second attribute indicates that the input image is an isolated point image.

28. The image processing apparatus according to claim 26, wherein the first attribute indicates that the input image is an all black image and the second attribute indicates that the input image is an isolated line image.

* * * * *